United States Patent [19]

Dick

[11] Patent Number: 4,554,537

[45] Date of Patent: Nov. 19, 1985

[54] GAS PLASMA DISPLAY

[75] Inventor: George W. Dick, Sinking Spring, Pa.

[73] Assignee: AT&T Bell Laboratories, Murray Hill, N.J.

[21] Appl. No.: 437,154

[22] Filed: Oct. 27, 1982

[51] Int. Cl.[4] ..... G09F 9/313

[52] U.S. Cl. ..... 340/775; 340/773; 340/779

[58] Field of Search ..... 340/775, 773, 771, 776, 340/768, 769, 779, 781; 313/491, 492

[56] References Cited

U.S. PATENT DOCUMENTS

| | | | |
|---|---|---|---|
| 3,866,090 | 2/1975 | Van Gelder et al. | 340/775 |
| 3,886,404 | 5/1975 | Kurahashi et al. | 340/775 |
| 3,989,974 | 11/1976 | Tottori et al. | 313/217 |
| 4,109,181 | 8/1978 | Murase et al. | 340/779 |
| 4,160,932 | 7/1979 | Mikoshiba et al. | 340/775 |
| 4,164,678 | 8/1979 | Biazzo et al. | 313/220 |
| 4,328,489 | 5/1982 | Ngo | 340/713 |

FOREIGN PATENT DOCUMENTS 1513944 6/1978 United Kingdom .

OTHER PUBLICATIONS

L. A. Jansen, "Matrix Addressing for Gas Panels Using a Third Addressing Axis", IBM Technical Disclosure, vol. 23, No. 7B, Dec. 1980, pp. 3274–3276.

*Primary Examiner*—Gerald L. Brigance
*Assistant Examiner*—Jeffery A. Brier
*Attorney, Agent, or Firm*—Lester H. Birnbaum

[57] ABSTRACT

Disclosed is an AC gas plasma display which provides the benefits of a planar display and permits a substantial separation of the write/erase and sustain function circuitry. First and second arrays of parallel electrodes ($X_1$-$X_3$, $Y_1$-$Y_6$) are disposed orthogonally on opposite surfaces within the gas envelope. One of the arrays includes a plurality of adjacent pairs of electrodes, e.g., $Y_3$ and $Y_4$, capable of sustaining glow discharges at the crosspoints of the two arrays. A desired area is illuminated or extinguished in a two-step sequence by applying appropriate pulses to selected electrodes in both arrays. For further separation of write/erase and sustain functions, one of the arrays can include a plurality of sets of three adjacent electrodes ($Y_1'$, $Y_2'$, $Y_3'$ of FIG. 10), with write/erase pulses applied to one of the electrodes and sustain pulses applied to the other two electrodes in the set.

12 Claims, 14 Drawing Figures

GAS PLASMA DISPLAY

BACKGROUND OF THE INVENTION

This invention relates to display devices, and in particular, to an AC-driven plasma display panel.

As known in the art, plasma display panels basically comprise a substrate with a dielectric layer thereon, and a cover, which may also include a dielectric layer, placed so as to define a gap therebetween. A gas which is capable of being ionized, such as neon with 0.1 percent argon added, is sealed within the gap. The display is defined by locally induced glow discharges in the gas produced by applying a desired potential to selected electrodes in arrays embedded in the dielectric layers.

In one form of plasma display panel, herein designated the "twin-substrate" design, a first array of parallel electrodes is embedded in the dielectric on the substrate, and a second array is embedded in the dielectric on the cover in a direction orthogonal to the first array so as to define display sites at the crosspoints of the two arrays. A desired site is displayed by applying write pulses of opposite polarities to selected electrodes in the top and bottom arrays which are sufficient to create a plasma at the crosspoint of the two electrodes. This, in turn, causes a glow discharge at the crosspoint for a short period of time. The electrons and positive ions of the plasma tend to accumulate in the site at opposite surfaces of the dielectrics so that a "wall" voltage is created and remains at the site when the write pulses are removed. The glow discharge is therefore retained at the site by applying to the two electrodes "sustain" pulses having smaller amplitudes than the write pulses and an initially reverse polarity. The sustain pulses do not have a sufficient magnitude to cause breakdown of the gas and so only sites which have previously been written will glow as a result of the wall voltage which remains from the write pulses. The sustain pulses are continuously applied as an AC signal to cause a shift in the accumulation of charge with each polarity shift and keep the site glowing until an erase signal is applied to the electrodes. The erase signal, again, includes pulses of opposite polarities applied to the two electrodes, but of a magnitude or duration which eliminates the wall voltage at the site.

The twin substrate design, although adequate, suffers from several drawbacks. The circuitry for applying the signals is fairly complex since the sustain signal is a relatively high current signal requiring application to all electrodes while the write/erase signal is a low current signal requiring application to only selected electrodes at any given time, and yet both signals are supplied by the same circuitry to the same electrodes. Further, the gap between dielectrics on the cover and substrate must be tightly controlled otherwise variations in the sustain fields at different sites will result causing glow crosstalk to unaddressed sites during sustain periods or alternatively, extinction during sustain periods of previously addressed sites. In addition, ion bombardment of the cover surface during the application of the AC sustain signal makes it impractical to include a photoluminescent phosphor on said surface to enhance the display. (For discussions of typical twin substrate designs, see, for example, U.S. Pat. No. 3,989,974 issued to Tottori et al. and U.S. Pat. No. 4,328,489 issued to Ngo.)

In order to remove some of these drawbacks, a "single substrate" design has also been proposed for AC plasma displays. In such a structure, the two arrays are both placed on the substrate and are separated by a dielectric layer. Again, display sites are formed at or near the crosspoints of the two arrays. However, since the electrodes are confined to a single substrate, the gap between substrate and cover is no longer critical, and further, a phosphor can be deposited on the cover since there is no ionic bombardment of that surface. (See, e.g., U.S. Pat. No. 4,164,678 issued to Biazzo et al.) However, the write/erase and sustain signals are still applied in essentially the same manner as the twin substrate design and so the complexity of the addressing circuitry was not reduced.

Several variations of the twin substrate design have also been proposed. For example, U.S. Pat. No. 3,989,974 issued to Tottori et al. utilizes auxiliary electrodes (25–32, 33–40) placed at both surfaces of the gas envelope and adjacent to the traditional electrodes (9–16, 17–24) previously described. The write/erase signals are supplied to the auxiliary electrodes in both substrates by means of switching electrodes (41–46, 47–52) removed from the display area, and the sustain signals are applied to the traditional electrodes. The mechanism for turn-on and erase of the display sites is not specified, but is believed to be some sort of triggering phenomenon associated with the proximity of the auxiliary electrodes to the main electrodes.

In this regard, *IBM Technical Disclosure Bulletin,* Vol. 23, No. 7B, December 1980, pp. 3274–3276, also describes use of auxiliary electrodes on both sides of the gas envelope which are used to sensitize adjacent crosspoint regions of the main electrodes. This can be done by any of three methods designated interstitial cell priming, capacitive coupling, and wall charge transfer mode. The first utilizes the auxiliary electrodes to produce photons at the selected crosspoint to lower the threshold of the adjacent main electrode crosspoint to cause the glow discharge. In the second method, each auxiliary electrode is capacitively coupled to an adjacent main electrode so that any pulses supplied to the auxiliary set will be coupled to the main set, while a cancellation pulse inhibits writing in non-selected regions. In the third method, the auxiliary electrodes are wider than the main electrodes so that the threshold for the auxiliary electrode crosspoints is less than the main electrode crosspoints. A combination of cancellation pulse applied to an auxiliary electrode and write pulse to the selected main electrodes selects the site to be displayed.

A further proposal for separating write/erase and sustain signals in a twin substrate design can be found in British Pat. No. 1,513,944 issued to Tsui et al. There, certain conductive lands embedded in both dielectric layers provide the sustain signal to the main electrodes by resistive coupling, while certain other conductive lands embedded in both dielectric layers provide the write/erase signal to the main electrodes by capacitive coupling.

While these proposals all provide some means for separating the write/erase and sustain signals, they all suffer from the disadvantages of the twin substrate design previously mentioned.

In the single substrate design area, proposals have been made to utilize two row conductors at each site in order to minimize external connections and simplify driver circuitry. (See, e.g., U.S. Pat. No. 4,164,678 issued to Biazzo et al.) However, to the best of applicant's knowledge, no satisfactory proposal has been made concerning how the write/erase and sustain functions can be separated in a single substrate design.

It is, therefore, a primary object of the invention to provide a plasma display structure and method of operation which maintains the benefits of a single substrate design while permitting a substantial separation of the write/erase and sustain functions.

SUMMARY OF THE INVENTION

This and other objects of the invention are achieved in accordance with the invention, which in one aspect is a display device and in another aspect is a method of operating a display device. In its device aspect, the invention comprises a first substrate including a first dielectric layer formed over one surface, a second substrate including a second dielectric layer formed over one surface and placed over the first substrate so as to define a gap between the two layers, and a gas capable of forming a glow discharge which occupies the gap. First and second arrays of electrodes are formed on the surfaces of the first and second substrates, covered by said dielectric layers, and positioned so as to form crosspoint regions between the electrodes of the two arrays. The first array comprises a plurality of pairs of electrodes which are spaced in at least the crosspoint regions such that a glow discharge may be sustained at the surface of the dielectric between the electrodes of each pair. Means are provided for supplying a voltage selectively to the electrodes of the first and second arrays in order to select pairs of electrodes for initiation and extinction of the glow discharge at desired crosspoint regions. Means are also provided for supplying a voltage to the electrodes of the first array to sustain a glow discharge between the pairs of electrodes selected for glow discharge at the desired crosspoint regions.

In accordance with the method of operating the device, a desired crosspoint region is selected for display by applying a pulse of one polarity to a selected electrode in the second array and a pulse of opposite polarity to a selected first electrode in the first array in the desired crosspoint region sufficient to cause a net accumulation of charges of opposite polarities on the dielectric layers over the two electrodes. A pulse is then applied to another electrode in the first array in the desired crosspoint region. This pulse has the same polarity as the pulse previously applied to the electrode in the second array and is sufficient to transfer the charges accumulated over the electrode of the second array to the dielectric layer portion over the said another electrode in the first array. This results in charge accumulation over the two electrodes in the first array sufficient to produce a glow discharge therebetween which can be sustained by AC signals of opposite polarities applied to the two electrodes of the first array.

BRIEF DESCRIPTION OF THE DRAWING

These and other features of the invention are delineated in detail in the following description. In the drawing.

It will be appreciated that for purposes of illustration, these figures are not necessarily drawn to scale.

DETAILED DESCRIPTION OF THE INVENTION

Figure 1:
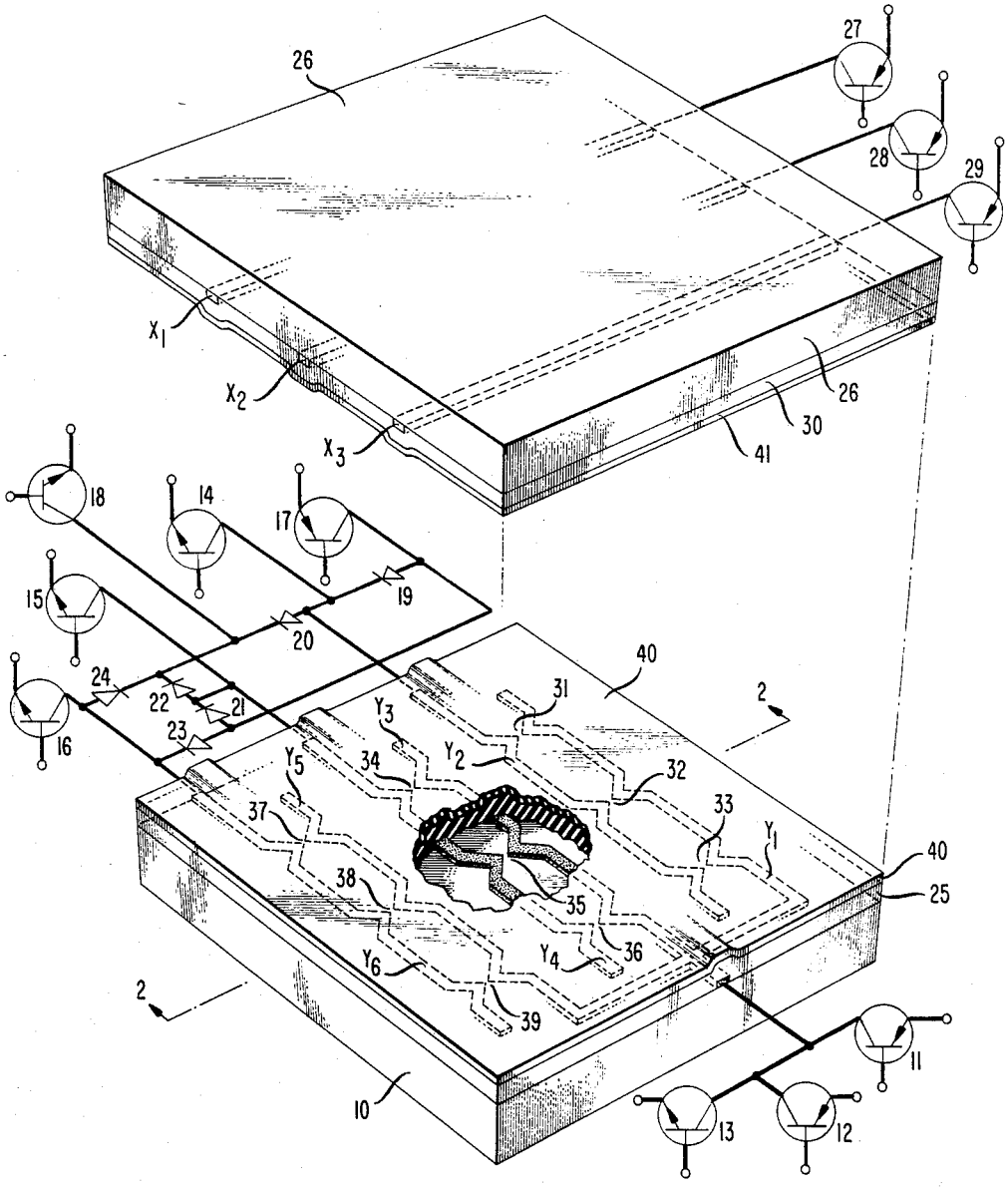
FIG. 1 is a partly schematic, exploded, perspective view, of a display device in accordance with one embodiment of the invention.

The basic components of the display device are illustrated in FIG. 1. Upon a first transparent substrate, 10, is disposed a first array of electrodes. (It will be appreciated that this figure is for illustrative purposes and that an actual device would include many more electrodes.) The array includes, in this example, three pairs of electrodes ($Y_1$ and $Y_2$, $Y_3$ and $Y_4$, $Y_5$ and $Y_6$) running in an essentially parallel direction. At desired display regions, 31–39, the electrodes in the pairs are brought sufficiently close together to permit a glow discharge as explained below. In this example, there are three such regions for each electrode pair. One electrode in each pair ($Y_1$, $Y_3$, $Y_5$) is connected in common to appropriate circuitry which, in this example, includes two p-n-p transistors, 11 and 12, and one n-p-n transistor, 13, with collectors coupled in parallel. The other electrodes of each pair ($Y_2$, $Y_4$, $Y_6$) are individually coupled to appropriate addressing circuitry, which in this example, includes a separate n-p-n transistor (14, 15, 16) coupled to each electrode and a pair of transistors (17, 18), one a p-n-p and the other an n-p-n, coupled to each of the electrodes and in parallel with the individual transistors (14, 15, 16) as shown. Individual diodes (19–24) are coupled between each of the transistors of the pair (17 and 18) and the electrodes ($Y_2$, $Y_3$ and $Y_4$).

Formed over the first array was a first dielectric layer, 25, commonly used in plasma displays. In this example, the layer was a lead oxide solder-glass with a thickness of 10 to 20 microns.

On a second transparent substrate, 26, which may also be considered as the cover for the device, a second array of electrodes was formed. This array included three essentially parallel electrodes, $X_1$, $X_2$, $X_3$, disposed so as to be essentially orthogonal to the electrodes of the first array. Each of these electrodes was coupled to appropriate addressing circuitry, which in this case included individual p-n-p transistors, 27, 28, 29, coupled to each electrode. A second dielectric layer, 30, which in this case was identical to the first dielectric layer, was formed over the electrodes in the first array.

Also formed over the dielectric layers 25 and 30 were additional layers 40 and 41, respectively. Typically, these layers comprise a thin layer of a low-work function material to provide good electron emission. In this example, each layer was a composite of a $CeO_2$ glue layer approximately 1,000 Angstroms thick and a layer of MgO approximately 1,500 Angstroms. It will be noted that these layers are omitted from subsequent figures for the sake of simplicity in the illustrations.

The two substrates were disposed in a parallel relationship to form a small gap, G, between them. (See FIGS. 2–6.) (It will be appreciated that the distance between substrates in FIG. 1 is greatly exaggerated for illustrative purposes.) In this example, the gap distance was approximately 125 microns. Although not shown in the drawing, in accordance with standard design the gap region was sealed after introducing therein an ionizable gas, which in this example, was neon with 0.1 percent argon added. The electrodes of the two arrays were disposed so that the $X_1$–$X_3$ electrodes crossed the $Y_1$–$Y_6$ electrodes at the areas, 31–39, where the electrode pairs were in sufficient proximity to sustain a glow discharge. Thus, each crosspoint region included a pair of closely spaced electrodes from the first array and one electrode orthogonal thereto from the second array.

Returning to the addressing circuitry, it will be noted that the collectors of each transistor are coupled to the appropriate electrodes and the emitters and bases of each transistor are shown coupled to terminals. It will be appreciated that since these transistors are usually part of an integrated circuit, the use of identifiable terminals is primarily schematic and intended to indicate that an appropriate potential will appear at that portion of the circuit during the operation of the device as explained below. It will also be appreciated that the bipolar transistors are intended as primarily illustrative of switches which permit application of the appropriate potential at the appropriate times.

Figure 13:
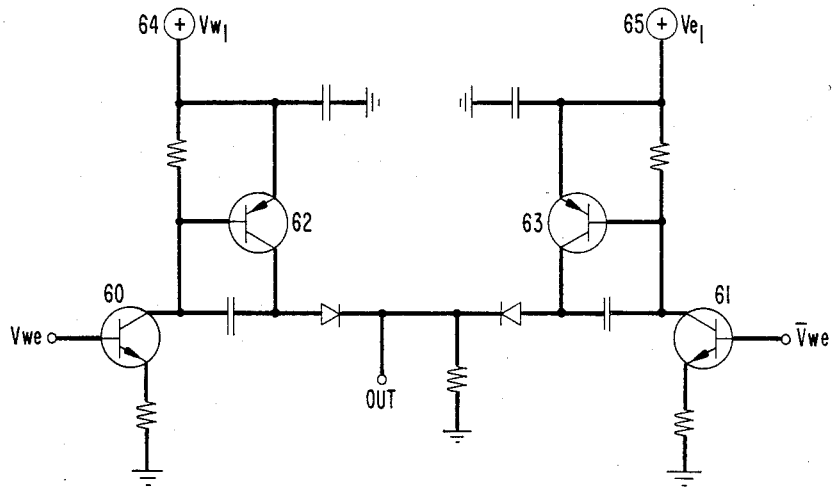
FIGS. 13 and 14 are circuit diagrams of a portion of the circuitry utilized to operate the embodiment of FIG. 1.
Figure 14:
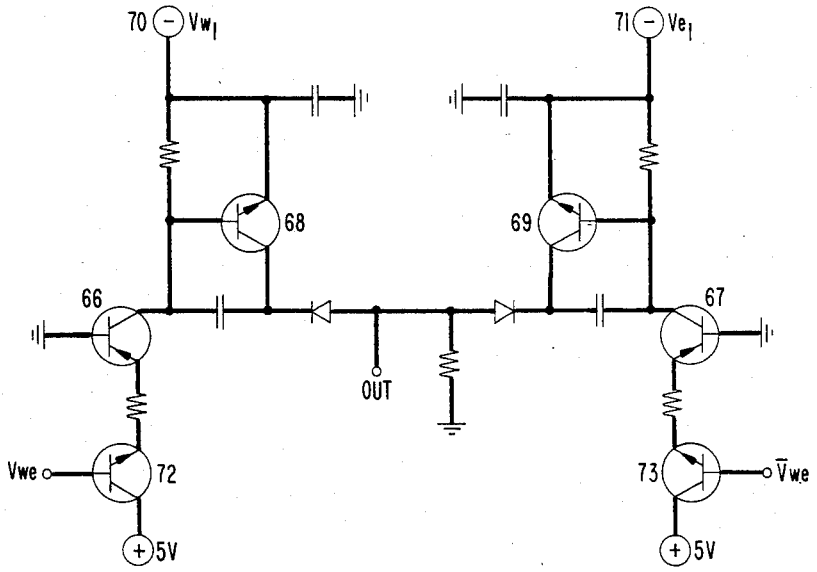

Additional portions of the circuitry for addressing the device of FIG. 1 are shown in FIGS. 13 and 14. In particular, FIGS. 13 and 14 illustrate examples of circuitry for switching the potential applied to the X electrodes and Y electrodes, respectively, between a write pulse $V_{w1}$ and an erase pulse $V_{e1}$. A detailed description of every component is not believed necessary. Basically, the circuit of FIG. 13 includes two n-p-n transistors, 60 and 61, each with its collector coupled to the base of a p-n-p transistor (62 and 63, respectively). The base of transistor, 60, is coupled to a terminal at which a low-level write-enable pulse $V_{we}$ is supplied, and the base of transistor, 61, is coupled to a terminal at which the complement, $\overline{V_{we}}$ is supplied. The emitter of transistor, 62, is coupled to a terminal, 64, at which a constant potential $V_{w1}$ is supplied, while the emitter of transistor 63 is coupled to a terminal, 65, at which a constant erase level $V_{e1}$ is supplied. The collectors of 62 and 63 are coupled to the out terminal which is coupled to the emitters of transistors, 27, 28 and 29, of FIG. 1. Thus, at an appropriate time as described below, a write pulse can be supplied to 27, 28 and 29 by supplying a pulse to the base of transistor, 60, which turns it on. This, in turn, causes transistor, 62, to conduct and the potential $+V_{w1}$ at terminal, 64, will appear at the output. At all other times, $\overline{V_{we}}$ will supply a potential to the base of transistor, 61, to turn it on which causes transistor, 63, to conduct and the erase potential $V_{e1}$ from terminal, 65, will appear at the output. The circuit of FIG. 14 supplies a $-V_{w1}$ or $-V_{e1}$ potential to the emitters of transistors, 14, 15 and 16, in substantially the same way by providing transistors, 66, 67, 68 and 69, which have a polarity opposite to the corresponding transistors (60, 61, 62, 63) of FIG. 13. One difference is that the $V_{we}$ and $\overline{V_{we}}$ potentials are supplied to the bases of additional n-p-n transistors, 72 and 73, respectively. These transistors have their emitters coupled to the emitters of p-n-p transistors, 66 and 67. The use of the additional transistors is to provide the higher currents needed to drive the emitters of transistors 66 and 67 with the same polarity of enable pulses.

The operation of the device will now be described with reference to the cross-sectional view along line 2—2 of FIG. 1 which is shown in FIGS. 2–6 illustrating different phases of the operation, and FIG. 7 which shows typical waveforms applied to the electrodes.

Figure 7:
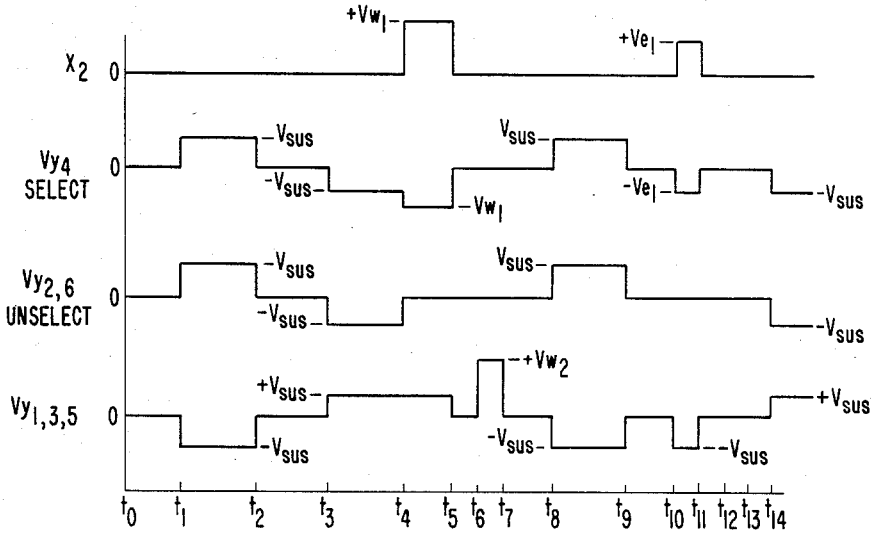
FIG. 7 is an illustration of a typical signal waveform utilized to operate the display device in accordance with the same embodiment.

From time t=0 to t=4 as shown by the waveforms of FIG. 7, it is assumed that the crosspoint including $Y_5$, $Y_6$ and $X_2$ has previously been selected for display (prior to t=0), and the glow discharge is being sustained at all selected crosspoints by applying pulses of magnitude $+V_{sus}$ to all "Y" electrodes. The polarities of the pulses applied to $Y_{1,3,5}$ and $Y_{2,4,6}$ are always opposite, however, so that the combined potential is sufficient to sustain the glow discharge at previously selected sites but insufficient to initiate any glow discharge. Thus, in this example, at $t_1-t_2$ a voltage of $+V_{sus}$ was applied to the terminal coupled to the emitter of transistor, 17, while the transistor was enabled by an appropriate potential to its base terminal so that a positive sustain pulse of approximately 50 volts was applied to electrodes $Y_2$, $Y_4$ and $Y_6$. At the same time, a voltage of $-V_{sus}$ was applied to the terminal coupled to the emitter of transistor, 13, while that transistor was enabled by an appropriate potential to its base so that a potential of approximately −50 volts was applied to electrodes $Y_1$, $Y_3$ and $Y_5$. This causes a glow discharge at the crosspoint region including $Y_6$ and $Y_5$ (and other sites) where charge has accumulated as the result of a write operation to be described. The signal to the Y electrodes is reversed at $t_3$ to $t_4$ by enabling transistor 18 which has a voltage of $-V_{sus}$ at its terminal and transistor 11 which has a voltage of $+V_{sus}$ at its terminal so that the applied potential in combination with the "wall voltage" of the accumulated charge produces another glow discharge. (It will be appreciated that the potential applied to the electrode is approximately equal to the voltage at the emitters of the transistors.) During this time period, transistors 14, 15 and 16 coupled to $Y_2$, $Y_4$ and $Y_6$, transistor 12 coupled to $Y_1$, $Y_3$ and $Y_5$, and transistors 27, 28 and 29 coupled to $X_1$, $X_2$ and $X_3$ are all disabled.

At time $t_4$, it is assumed that it is desired to initiate a glow discharge (write) in the crosspoint region including electrodes $X_2$, $Y_3$ and $Y_4$. Thus, a voltage of $+V_{w1}$ was applied to electrode $X_2$ by enabling transistor, 28, which had a potential of $+V_{w1}$ supplied to its emitter by the circuit of FIG. 13. In this example, the potential was approximately 90 volts. At the same time a voltage of $-V_{w1}$ was applied to electrode $Y_4$ by enabling transistor 15 which had a potential of $-V_{w1}$ applied to its emitter by the circuit of FIG. 14. This negative potential will reverse-bias diodes 19, 22 and 23, and thereby decouple the write signal from the unselected electrodes $Y_2$ and $Y_6$ (the unselected electrodes continue to receive the normal sustain signal, which at this point has gone to zero potential). The positive sustain pulse to the $Y_1$, $Y_3$ and $Y_5$ electrodes is also extended for the duration of the write pulse in order to cancel the effect of negative surface charges at previously written locations over these electrodes (e.g., $Y_5$). Such charges, if not held by the sustain voltage extension, could cause unwanted discharges to the pulsed cover electrode resulting in erasure of these "on" cells.

Figure 2:
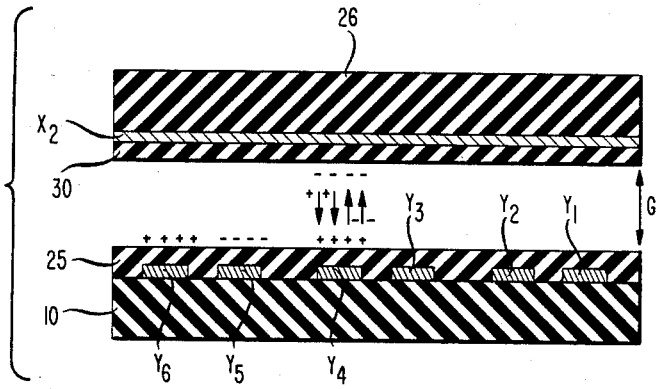
FIGS. 2–6 are schematic cross-sectional views along line 2—2 of FIG. 1 illustrating operation of the device in accordance with one embodiment of the invention.

The potential difference between electrodes, $X_2$ and $Y_4$, therefore initiates a glow discharge in the gap between these electrodes for a short period of time. More importantly, positive ions and electrons from the gas begin to accumulate at electrodes $Y_4$ and $X_2$, respectively, as a result of the applied potential. FIG. 2 illustrates the charge build-up at the end of the write pulse ($t_5$). At $t_5$, the write pulses were removed from electrodes, $X_2$ and $Y_4$ and the sustain pulses removed from $Y_1$, $Y_3$ and $Y_5$. However, the accumulated charges remained at the dielectric surfaces at least until the next pulse was supplied ($t_6$).

Figure 3:
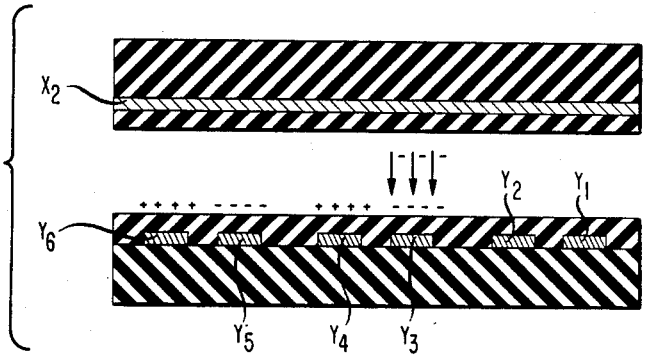

At time $t_6$, with all other transistors disabled, transistor, 12, was enabled and a potential of $+V_{w2}$ applied to its terminal. This pulse is designed to have sufficient magnitude and duration to cause transfer to the area of the dielectric above electrode, $Y_3$, of essentially all the electrons which had accumulated at electrode, $X_2$, as a result of the previous pulse. In this example, the potential was approximately 120 volts and the duration of the pulse was approximately 3–4 μsec (one-half of the write pulse duration). Thus, at time $t_7$, as illustrated in FIG. 3, the electrons from the cover have accumulated on the portion of the dielectric over electrode, $Y_3$, while the ions over electrode, $Y_4$, have essentially remained in place. There now exists a wall voltage between the areas over electrodes, $Y_3$, and $Y_4$, which initially produces a glow discharge and which is sufficient to produce a glow discharge in the area over electrodes, $Y_3$ and $Y_4$, when pulses of sufficient magnitude and the same polarity as the charge ($+V_{sus}$ and $-V_{sus}$) are applied to these electrodes.

Figure 4:
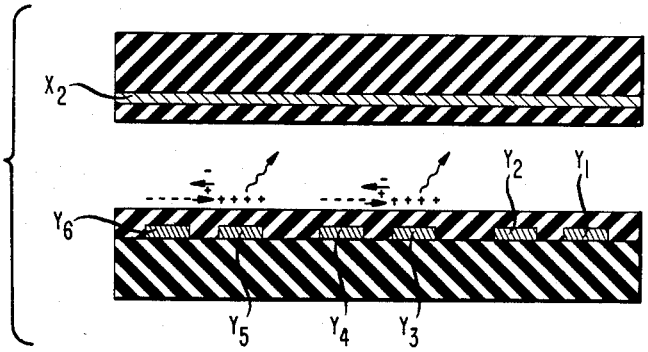

The normal sustain signal is therefore applied to all the Y electrodes at $t_8$ to $t_9$ in the same manner as at $t_1$ to $t_2$. This causes a glow discharge between $Y_3$ and $Y_4$ (as well as the previously written site including $Y_6$ and $Y_5$) and also results in a reversal of the charge accumulation by $t_9$ as shown in FIG. 4 so that a new discharge will result upon a reversal of the polarity of the applied pulses. That is, the glow discharge between $Y_3$ and $Y_4$ will continue as the sustain signal is applied until the site is chosen for extinction of the discharge.

At time $t_{10}$, it is assumed that it is desired to extinguish the discharge in the crosspoint region including electrodes $X_2$, $Y_3$ and $Y_4$. Thus, erase pulses were supplied to both electrodes $X_2$ and $Y_4$. A potential of $+V_{e1}$, which is approximately 50 volts in this example, was supplied to electrode, $X_2$, by enabling transistor, 28. As previously discussed, the circuit of FIG. 13 supplies the $V_{e1}$ potential to the emitters of transistors, 27, 28 and 29 at all times except during a write phase. A pulse of $-V_{e1}$ was supplied to electrode, $Y_4$, by enabling transistor, 15, which has supplied to its emitter the $-V_{e1}$ potential from the circuit of FIG. 14. All other transistors were disabled at this point.

Figure 5:
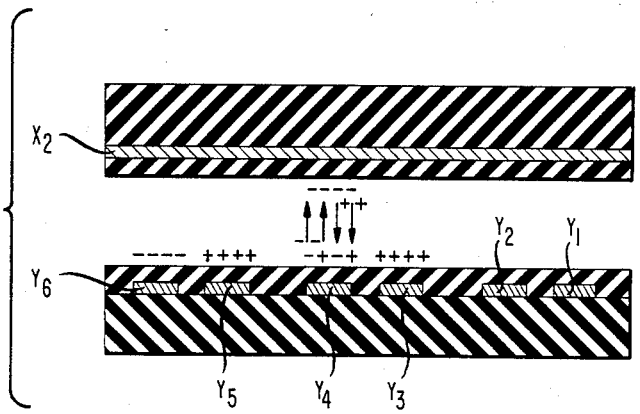
Figure 6:
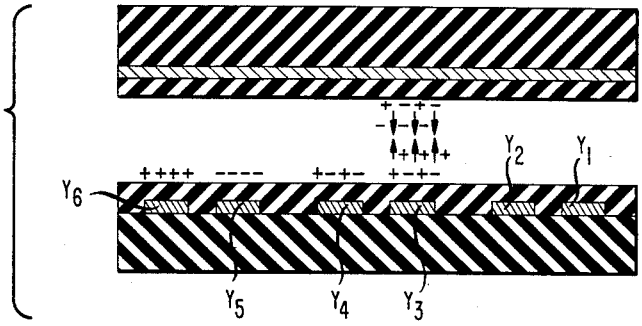

The application of this pulse causes electrons which had accumulated over $Y_4$ to transfer to the dielectric over electrode, $X_2$, and also to attract ions from the gas to the dielectric surface over $Y_4$ in much the same way as the write phase previously described. However, the magnitude and duration of this erase pulse is chosen so that the transfer of charge is not completed. Rather, an approximately equal number of ions and electrons accumulates over $Y_4$ at time $t_{11}$ as shown in FIG. 5 so that the charge above $Y_4$ is neutralized. In this example, the duration of the pulse was approximately 4 μsec. In addition, a negative sustain pulse of $-V_{sus}$ is applied to $Y_{1,3,5}$ in order to hold positive charge over electrodes which had previously been written (e.g., $Y_5$) where erasure is not desired. Otherwise, such charge might discharge to an adjacent electrode being erased ($Y_4$). Next, if desired, a positive pulse of $+V_{e2}$ could be supplied to electrode $Y_3$ (as well as $Y_1$ and $Y_5$) at $t_{12}$ to attract essentially all the electrons which had accumulated over $X_2$ to the dielectric over $Y_3$ while repelling an equal number of ions to neutralize the charge over $Y_3$. However, it was discovered that this additional erase pulse is not necessary. Rather, when the normal positive sustain pulse is supplied to electrodes $Y_{1,3,5}$ at time $t_{14}$ as shown in FIG. 7, the same neutralization of charge over $Y_3$ will occur. FIG. 6 represents the situation at a short time (approximately 1 μsec) after time $t_{14}$. Thus, the wall voltage at the dielectric surface is now insufficient to produce a glow discharge when the later sustain signal is applied, and this crosspoint region is now extinguished until a new write pulse is applied. It will be noted that this sequence of pulses has not affected adjacent sites which include electrodes, $Y_5$, $Y_6$ and $Y_1$, $Y_2$.

Several important features of the structure and method of operation should be noted. Basically, each write and erase operation is a two-step process, with charge being transferred to the X electrode while charge of opposite polarity accumulates on one Y electrode in one step and then the charge accumulated at the X electrode is transferred to the other Y electrode at the crosspoint region in the second step. Once the glow discharge at a desired crosspoint is initiated, it is sustained only by a signal applied to the Y electrodes. Thus, there is only a brief and infrequent discharge between the two substrates at any particular crosspoint region. This allows more tolerance to the gap distance between the dielectric layers on the substrates since the glow discharge display is not dependent thereon, and also permits a photoluminescent phosphor layer (shown, for example as layer 60 in FIG. 9) to be included on the cover substrate since it will not be subject to significant ionic bombardment during device operation. Further, the addressing and sustain functions have been substantially separated, although some overlap still exists. Thus, only addressing circuitry is needed for the X electrodes. For the Y electrodes, addressing circuitry providing selection of individual electrodes is needed only for the $Y_2$, $Y_4$ and $Y_6$ electrodes. While some write/erase function is needed on $Y_1$, $Y_3$ and $Y_5$ (via transistor, 12), it can be applied to all such electrodes in common. Of course, some combination of addressing and sustain circuitry is needed for the $Y_2$, $Y_4$ and $Y_6$ electrodes, but this is believed to be minimal. If desired, the entire sustain signal could be placed on the $Y_1$, $Y_3$ and $Y_5$ electrodes to increase separation. However, such a scheme tends to cause build-up of charge on the top electrode even when no pulse is supplied thereto due to the high voltage of a single sustain signal. Thus, it is preferred to split the sustain voltage between the electrodes in each pair.

The logic circuitry needed to select the desired electrodes in accordance with the above-described operation is believed to be well within the design capabilities of the skilled artisan and consequently is not discussed. It will be appreciated that the transistors shown in the addressing circuitry of FIG. 1 are primarily for illustrative purposes, and in actual practice other types of switches such as FETs may be used.

Figure 8:
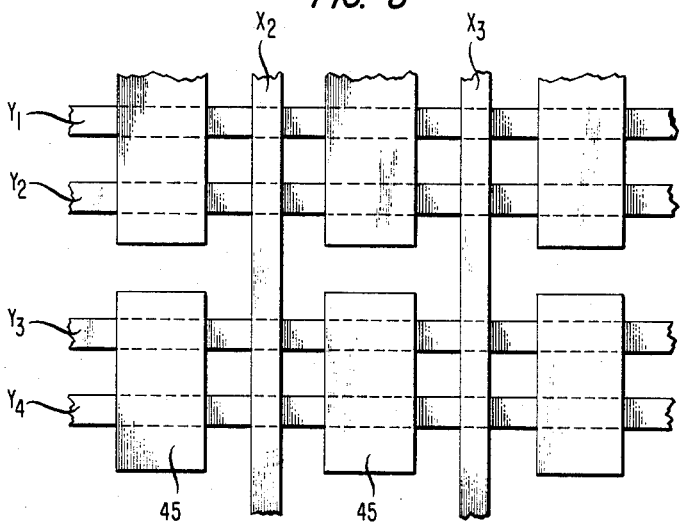
FIG. 8 is a top view of the electrode arrangement for a display device in accordance with a further embodiment of the invention.
Figure 9:
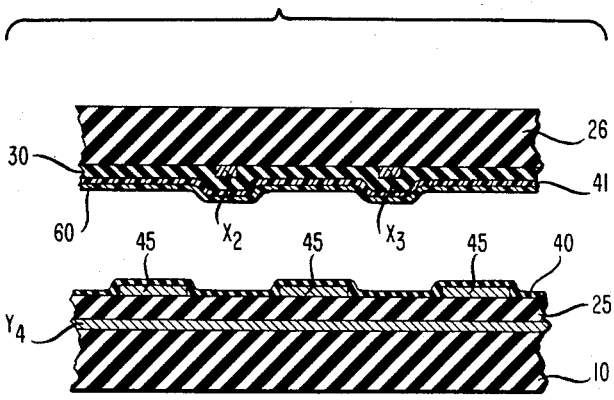
FIG. 9 is a cross-sectional view of a display device in accordance with the embodiment of FIG. 8.

Although FIG. 1 shows an embodiment where the Y electrode pairs are spaced far apart (approximately 10 mils) and are only brought close together (approximately 4 mils) in the display regions, it is possible to provide the electrode pairs with a uniform spacing as shown in FIGS. 8 and 9.

FIG. 8 is a top view of an arrangement of electrodes and FIG. 9 is a side view of a portion of a display panel in accordance with a further embodiment of the invention where elements corresponding to those of FIG. 1 are similarly numbered. As shown in FIG. 8, the Y electrodes are now essentially parallel with a uniform spacing, in this example, of approximately 0.004 inches. Glow discharges between the electrode pairs are confined to the crosspoint regions by use of blocking electrodes, 45, positioned over the electrode pairs between each X electrode. As illustrated in FIG. 9, these blocking electrodes are formed on the dielectric layer, 25, formed over the Y electrodes. The dielectric layer, 40, is, in turn, formed over the blocking electrodes and is composed of thin film coatings of $CeO_2$ and MgO as used in the previous example. The same coating is shown as layer 41 over the cover dielectric.

The blocking electrodes limit the lateral spread of the glow discharge between the Y electrodes so that the electrodes can be made parallel. This is done by capacitively coupling each blocking electrode equally to both Y electrodes in its underlying pair. Since the potential on the blocking electrode will therefore be a function of the sum of the potentials of the two electrodes in the pair, and such potentials are equal and opposite in sign during the sustain cycles, an essentially zero potential is created at the surface of the dielectric, 40, over the blocking electrodes (or at least a potential which is too small to sustain a discharge). These areas of zero potential form boundaries for the glow discharge. (For a detailed discussion of blocking electrodes in the single substrate design, see U.S. patent application of G. W. Dick, Ser. No. 362,097, filed Mar. 26, 1982 and assigned to the present assignee, which is incorporated by reference herein.) Although the blocking electrodes are shown as segmented in the vertical direction in FIG. 8, it should be appreciated that a single electrode could be used in each column between the X electrodes.

Figure 10:
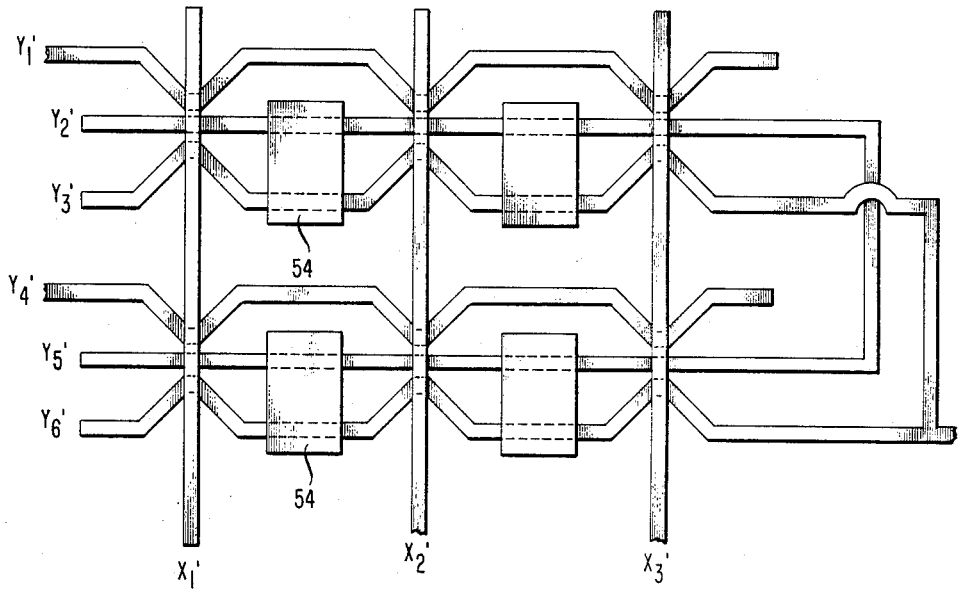
FIG. 10 is a top view of an electrode arrangement for a display device in accordance with a still further embodiment of the invention.
Figure 11:
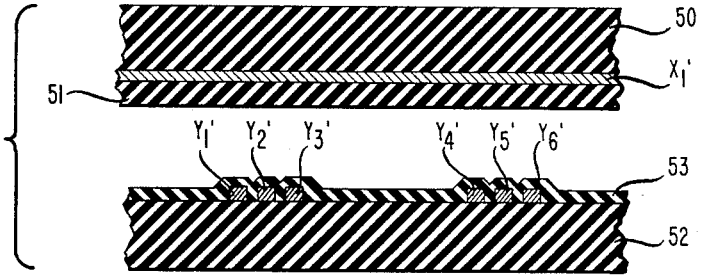
FIG. 11 is a cross-sectional view of a display device in accordance with the embodiment of FIG. 10.
Figure 12:
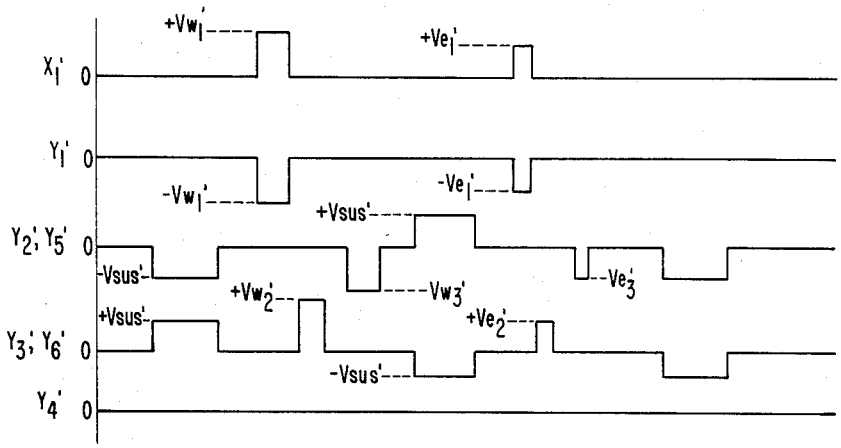
FIG. 12 is an illustration of a typical signal waveform utilized to operate the display device in accordance with the embodiment of FIGS. 10 and 11.

For more complete separation of the sustain and write/erase circuitry, a fourth electrode can be added to each crosspoint region as shown in the embodiment illustrated in the top view of the electrode configuration of FIG. 10 and cross-sectional view of a portion of a display in FIG. 11. For illustrative purposes, only a portion of the array is shown, but many more display sites would be included in a typical device. Here, again, the top substrate, 50, includes an array of parallel electrodes $X_1'$, $X_2'$, $X_3'$ embedded in the dielectric layer, 51, at the surface. In this embodiment, however, the array of electrodes formed on the bottom substrate, 52, and covered by dielectric layer, 53, includes a plurality of groups of three parallel electrodes, $Y_1'$, $Y_2'$, $Y_3'$ and $Y_4'$, $Y_5'$, $Y_6'$. With such a configuration, the sustain signal can be applied to two of the three electrodes at each crosspoint region, e.g., $Y_2'$ and $Y_3'$, and $Y_5'$ and $Y_6'$, to produce the glow discharge between those electrodes. The third electrode, e.g., $Y_1'$ and $Y_4'$, may be used together with the appropriate X' electrode to select the desired crosspoint region for initiation or extinction of the glow discharge by transfer of charge between the third electrode and X' electrode and later transfer of charge from the X' electrode to one of the other Y' electrodes at the crosspoint region as in the previous example. A third step could be added subsequently to transfer charge from the third electrode to the remaining Y' electrode at the crosspoint so a sufficient wall voltage is created over the two sustaining electrodes. The erase can follow the same sequence with the application of smaller pulses having a shorter duration so that charge over each electrode is neutralized as in the previous example. Again, blocking electrodes, 54, may be formed over the sustaining electrodes, $Y_2'$ and $Y_3'$, $Y_5'$ and $Y_6'$, and be capacitively coupled thereto in order to prevent the spread of the glow discharge to adjacent crosspoint regions. FIG. 12 illustrates typical voltage waveforms which may be applied to the electrodes to initiate and extinguish a glow discharge at the crosspoint including electrodes, $X_1'$, $Y_1'$, $Y_2'$ and $Y_3'$. In view of the detailed discussion in the previous example, a further detailed discussion of this example is not believed necessary.

It should be understood in the attached claims that "means for supplying a voltage" to achieve particular functions is intended to be broad enough so as not to require an external power supply.

Various additional modifications of the invention will become apparent to those skilled in the art. All such variations which basically rely on the teachings through which the invention has advanced the art are properly considered within the spirit and scope of the invention.

What is claimed is:

1. A display device comprising a first substrate including a first dielectric layer formed over one surface;

a second substrate including a second dielectric layer formed over one surface and placed with respect to the first substrate so as to define a gap region between the two dielectric layers;

a gas capable of forming a glow discharge occupying the gap;

first and second arrays of electrodes formed on the surfaces of the first and second substrates, covered by said dielectric layers, and positioned so as to form crosspoint regions between the electrodes of the two arrays, said first array comprising a plurality of at least pairs of electrodes which are spaced in at least the crosspoint regions such that a glow discharge may be sustained at the surface of the dielectric between the electrodes of each pair;

means for supplying a voltage selectively to the electrodes of the first and second arrays in order to select pairs of electrodes of the first array for initiation and extinction of a display glow discharge at desired crosspoint regions by accumulation of charge on the portions of the dielectric over the selected electrodes of the first and second array;

means for supplying a voltage to another electrode in the first array in the desired crosspoint region sufficient to transfer the charge accumulated over the electrode in the second array to the dielectric portion over the said another electrode; and means for supplying a voltage to both electrodes of each pair of the electrodes of the first array to sustain glow discharges between the pairs of electrodes selected for glow discharges at the desired crosspoint regions.

2. The device according to claim 1 wherein the first array includes an additional electrode at each crosspoint region with the means for selecting said pair of electrodes for initiation and extinction of the glow discharge being applied to the additional electrode and the means for sustaining the glow discharge applied to the other two electrodes.

3. The device according to claim 1 wherein the electrodes in a pair in the first array have an essentially uniform spacing.

4. The device according to claim 1 further comprising electrodes formed over and capacitively coupled to the pairs of electrodes in the first array in order to prevent the spread of the glow discharge beyond the crosspoint regions.

5. The device according to claim 1 wherein means for selecting initiation and extinction of a glow discharge and means for sustaining a glow discharge are both coupled to at least one electrode in each pair in the first array, and there is further included means for decoupling the said selecting means from electrodes in other pairs coupled to the same sustaining means when the selecting means to a particular electrode is activated.

6. The device according to claim 1 wherein one electrode from each pair is coupled in common to said means for sustaining a glow discharge.

7. A method of operating a display device which includes a first array of electrodes comprising a plurality of pairs of electrodes formed on a surface of a first substrate and covered by a first dielectric layer, a second array of electrodes formed on a surface of a second substrate and covered by a second dielectric layer, where the substrates are placed so as to form a gap between the dielectric layers and the electrodes of the two arrays are positioned to form crosspoint regions each including at least two electrodes from the first array and one electrode from the second array, and an ionizable gas occupies the gap, the method comprising selecting a desired crosspoint region for display including the steps of:

applying a pulse of one polarity to a selected electrode in the second array and a pulse of opposite polarity to a selected first electrode in the first array in the desired crosspoint region sufficient to cause a net accumulation of charges of opposite polarities on the dielectric layers over the two electrodes;

applying a pulse to a second electrode in the first array in the desired crosspoint region having the same polarity as the pulse previously applied to the electrode of the second array and sufficient to transfer the charges accumulated over the electrode in the second array to the dielectric layer portion over the said second electrode; and applying an AC signal to at least two electrodes in the first array at the desired crosspoint region to sustain a glow discharge between the dielectric portions over the said electrodes.

8. The method according to claim 7 wherein each crosspoint region includes only a pair of electrodes in the first array and transfer of charge to the said second electrode results in a potential between the dielectric portions over the pair of electrodes sufficient to cause a glow discharge.

9. The method according to claim 8 wherein the glow discharge is sustained by applying to each electrode in the pair an AC signal of opposite polarity.

10. The method according to claim 7 wherein each crosspoint region includes at least a third electrode in the first array and transfer of charge to the said second electrode is followed by applying a pulse to the third electrode of the same polarity as the pulse previously applied to the first electrode of the first array and sufficient to transfer the charges accumulated over the first electrode to the dielectric portion over the third electrode resulting in a potential between the dielectric portions over the second and third electrodes sufficient to cause a glow discharge.

11. The method according to claim 10 wherein the glow discharge is sustained by applying to the second and third electrode in each crosspoint region an AC signal of opposite polarity.

12. A display device comprising:

first and second substrates placed so as to define a gap region between them;

a gas capable of forming a glow discharge occupying the gap;

first and second arrays of electrodes formed in the gap region, covered by dielectric layers, and positioned so as to form crosspoint regions between the electrodes of the two arrays, said first array comprising a plurality of at least pairs of electrodes spaced in at least the crosspoint regions so that a glow discharge may be sustained at the surface of the dielectric between the electrodes of each pair;

means for supplying a voltage selectively to the electrodes of the first and second arrays in order to select pairs of electrodes of the first array for initiation and extinction of a display glow discharge at desired crosspoint regions by accumulation of charge on the portions of the dielectric over the selected electrodes of the first and second array;

means for supplying a voltage to another electrode in the first array in the desired crosspoint region sufficient to transfer the charge accumulated over the electrode in the second array to the dielectric portion over the said another electrode; and means for supplying a voltage to both electrodes of each pair of electrodes in the first array to sustain glow discharges between the pairs of electrodes selected for glow discharges at the desired crosspoint regions.

* * * * *